US007966933B2

(12) United States Patent
Koppelkamm et al.

(10) Patent No.: US 7,966,933 B2
(45) Date of Patent: Jun. 28, 2011

(54) APPARATUS AND METHOD FOR CLAMPING PRINTING PLATES ON A PLATE CYLINDER

(75) Inventors: Guenter Koppelkamm, Neuensalz (DE); Reinhard Naumann, Schkeuditz/Walteritz (DE); Katrin Schubert, Zwickau (DE)

(73) Assignee: MAN Roland Druckmaschinen AG, Augsburg (DE)

( * ) Notice: Subject to any disclaimer, the term of this patent is extended or adjusted under 35 U.S.C. 154(b) by 457 days.

(21) Appl. No.: 12/121,145

(22) Filed: May 15, 2008

(65) Prior Publication Data

US 2008/0282918 A1 Nov. 20, 2008

(30) Foreign Application Priority Data

May 18, 2007 (DE) ..... 10 2007 023 272

(51) Int. Cl.
*B41F 27/12* (2006.01)

(52) U.S. Cl. ..... 101/415.1; 101/378

(58) Field of Classification Search ..... 101/415.1, 101/409, 378; 271/277
See application file for complete search history.

(56) References Cited

U.S. PATENT DOCUMENTS

| | | | | |
|---|---|---|---|---|
| 2,929,323 | A | 3/1960 | Burgard | |
| 3,370,533 | A * | 2/1968 | Westra et al. | 101/269 |
| 7,406,917 | B2 * | 8/2008 | Naumann et al. | 101/415.1 |
| 2004/0237819 | A1 * | 12/2004 | Koppelkamm | 101/415.1 |
| 2006/0169158 | A1 * | 8/2006 | Koppelkamm | 101/415.1 |

FOREIGN PATENT DOCUMENTS

| | | | |
|---|---|---|---|
| DE | 43 19 167 | C2 | 12/1994 |
| DE | 197 03 290 | A1 | 8/1998 |
| DE | 20 2004 020 725 | U1 | 1/2006 |
| DE | 10 2005 002 684 | A1 | 8/2006 |
| DE | 10 2006 012 760 | A1 | 9/2007 |
| EP | 167861 | A2 * | 1/1986 |
| EP | 0 628 411 | A | 12/1994 |
| EP | 1 481 803 | A1 | 12/2004 |
| EP | 1 834 774 | A | 9/2007 |

* cited by examiner

*Primary Examiner* — Leslie J Evanisko
(74) *Attorney, Agent, or Firm* — Crowell & Moring LLP

(57) ABSTRACT

An apparatus and method for clamping printing plates on a plate cylinder is disclosed. A clamping element is integrated into a lockup slot of a plate cylinder with an actuating element. The clamping element is transferred by the actuating element between a first position, where the clamping element clamps the leading end and/or the trailing end of the printing plate, and a second position, where the clamping element releases the leading end and/or the trailing end of the printing plate. The clamping element can be adjusted exclusively in the radial direction of the plate cylinder and the actuating element exclusively in the axial direction of the plate cylinder such that, depending upon the relative axial position of the actuating element with respect to the clamping element, the clamping element is displaced either radially outwardly for clamping the printing plate or is displaced radially inwardly for releasing the printing plate.

14 Claims, 3 Drawing Sheets

APPARATUS AND METHOD FOR CLAMPING PRINTING PLATES ON A PLATE CYLINDER

This application claims the priority of German Patent Document No. 10 2007 023 272.3, filed May 18, 2007, the disclosure of which is expressly incorporated by reference herein.

BACKGROUND AND SUMMARY OF THE INVENTION

The invention relates to an apparatus and method for clamping printing plates on a plate cylinder. In addition, the invention relates to a plate cylinder.

Printing couples of printing presses, such as web-fed printing presses, for example, have a plate cylinder, a transfer cylinder, an inking couple as well as preferably a moistening unit. Printing plates are normally arranged on the plate cylinder, which is the reason why the plate cylinder is also called an engraving cylinder. Rubber offset blankets are normally positioned on the transfer cylinders, which is why the transfer cylinders are also designated as blanket cylinders.

Clamping mechanisms that are integrated into a lockup slot of the plate cylinder are used to arrange or clamp printing plates on the circumference of the plate cylinder. Such a clamping mechanism can be used to clamp a leading end and/or a trailing end of at least one to-be-clamped printing plate in the lockup slot.

Clamping mechanisms known from practice have a clamping element as well as an actuating element, whereby both the clamping element as well as the actuating element are integrated into a lockup slot of a plate cylinder. The actuating element can be used to transfer the clamping element between two positions, namely between a first position, in which the clamping element clamps the leading end and/or the trailing end of the or each printing plate, and a second position, in which the clamping element releases the leading end and/or the trailing end of the or each printing plate.

The disadvantage of clamping mechanisms for printing plates known from practice is that the clamping mechanisms can have a relatively complex structure.

Starting herefrom, the present invention is based on the objective of creating a novel clamping mechanism for printing plates having a simple structure and a plate cylinder with such a clamping mechanism.

According to the invention, the clamping element can be adjusted exclusively in the radial direction of the plate cylinder and the actuating element exclusively in the axial direction of the plate cylinder in such a way that, depending upon the relative axial position of the actuating element with respect to the clamping element, the clamping element can be displaced either radially outwardly due to a spring force of at least one clamping spring for clamping the leading end and/or the trailing end of the or each printing plate or can be displaced radially inwardly against the spring force of the or each clamping spring for releasing the leading end and/or the trailing end of the or each printing plate.

The inventive clamping mechanism for printing plates has a relatively simple structure. Thus, the inventive clamping mechanism has a clamping element, which can be adjusted exclusively in the radial direction of the plate cylinder, and an actuating element, which can be adjusted exclusively in the axial direction of the plate cylinder. Depending on the relative axial position of the actuating element with respect to the clamping element, the clamping element can either clamp or release the leading end and/or the trailing end of the or each printing plate in the lockup slot. To do so, the clamping element cooperates with at least one clamping spring.

Preferred developments of the invention are yielded from the following description. Without being limited hereto, exemplary embodiments of the invention are explained in greater detail on the basis of the drawings.

DETAILED DESCRIPTION OF THE DRAWINGS

Figure 1:
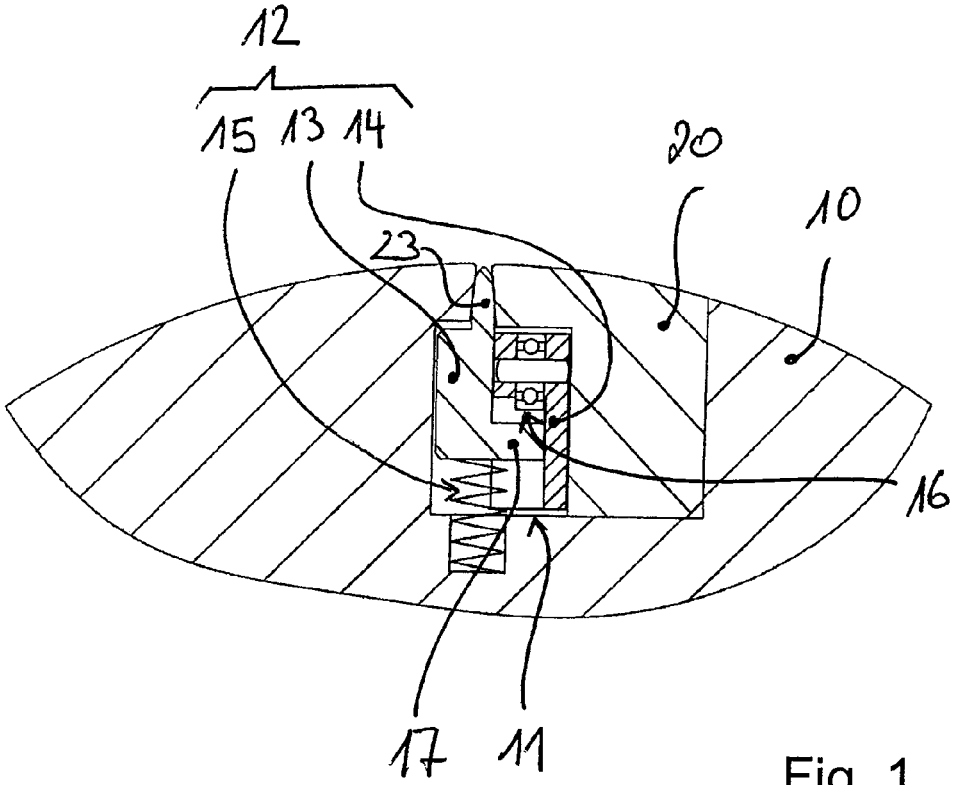
FIG. 1 is a schematic cross section through an inventive plate cylinder in the area of a lockup slot and an inventive clamping mechanism for printing plates that is integrated into the lockup slot in the first position of the clamping mechanism.
Figure 3:
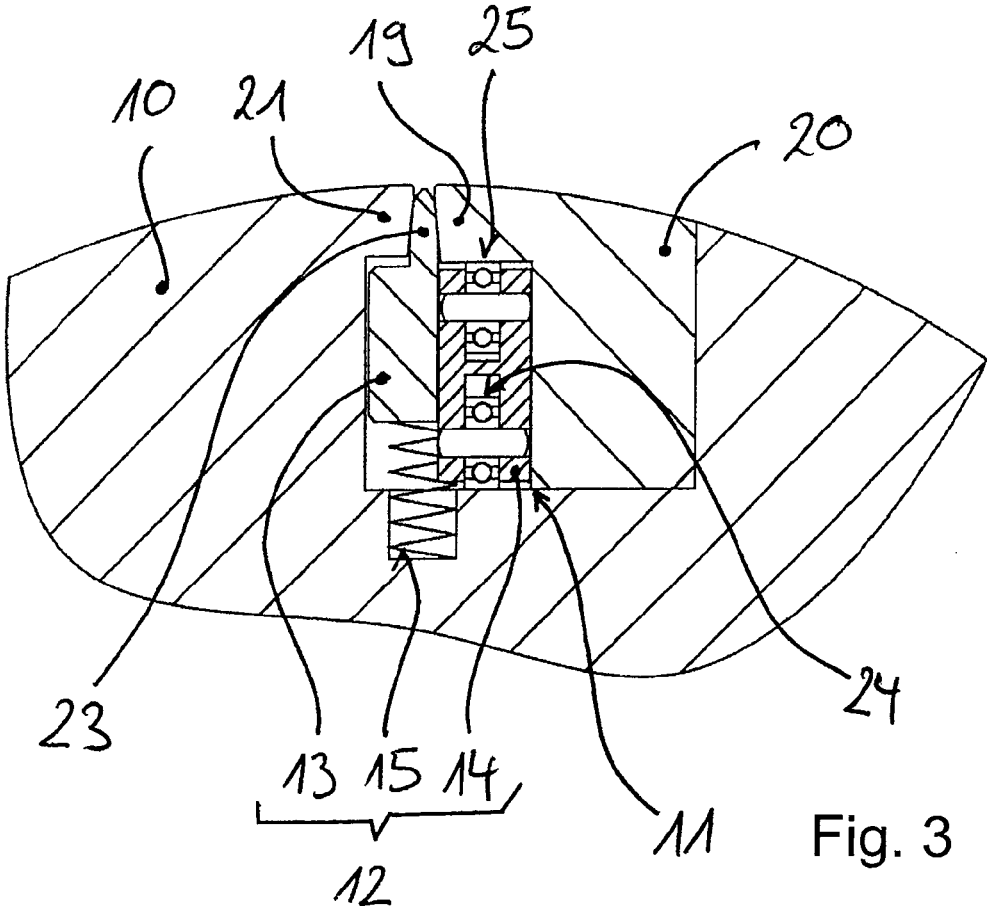
FIG. 3 is another schematic cross section through the inventive plate cylinder in the area of the lockup slot and the inventive clamping mechanism for printing plates that is integrated into the lockup slot in the first position of the clamping mechanism.
Figure 5:
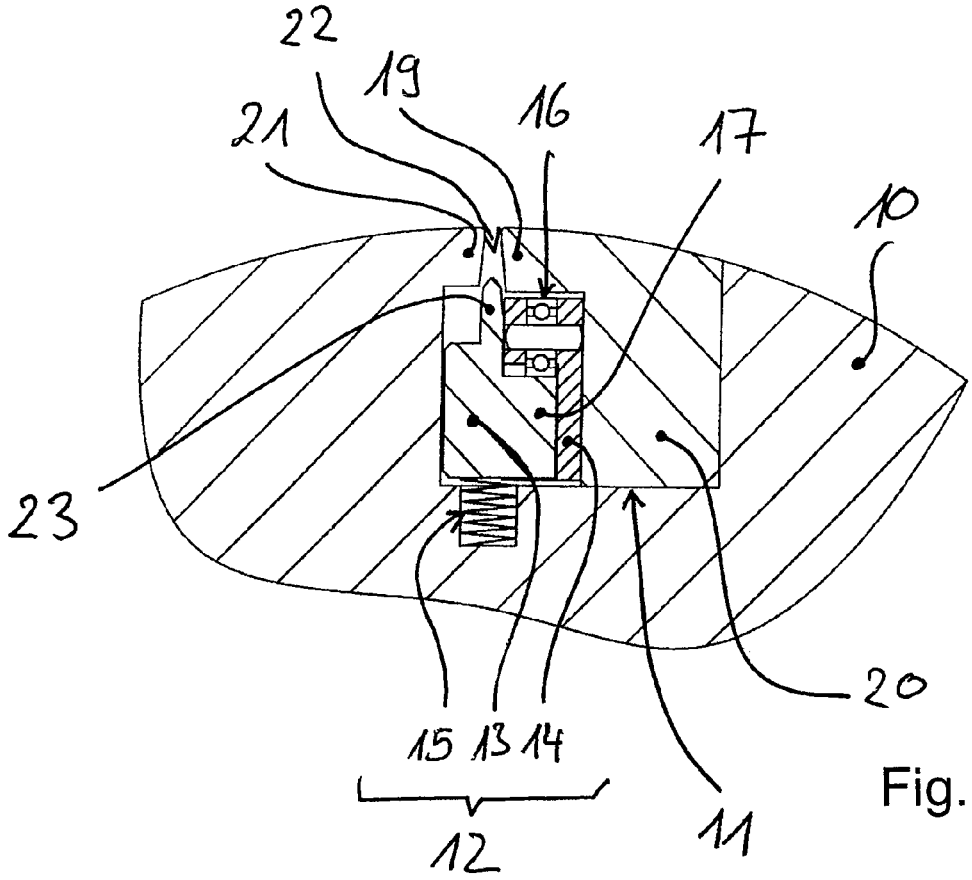
FIG. 5 is a schematic cross section through the inventive plate cylinder in the area of the lockup slot and the inventive clamping mechanism for printing plates that is integrated into the lockup slot in a second position of the clamping mechanism.

FIGS. 1, 3 and 5 each show schematic cross sections through an inventive plate cylinder 10 of a printing press in the area of a lockup slot 11 of the plate cylinder 10, whereby a clamping mechanism 12 for printing plates is integrated into the lockup slot 11 of the plate cylinder 10.

Figure 2:
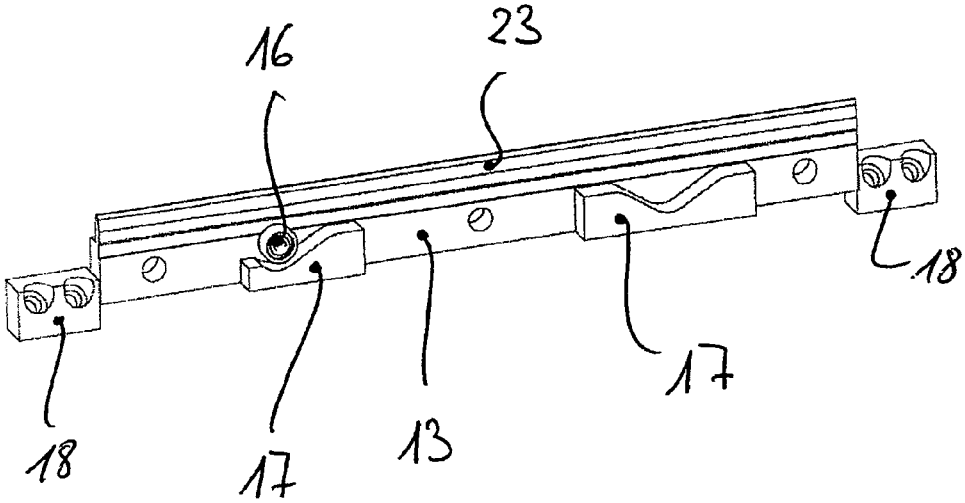
FIG. 2 is a perspective view of components of the inventive clamping mechanism in the first position of the clamping mechanism.
Figure 4:
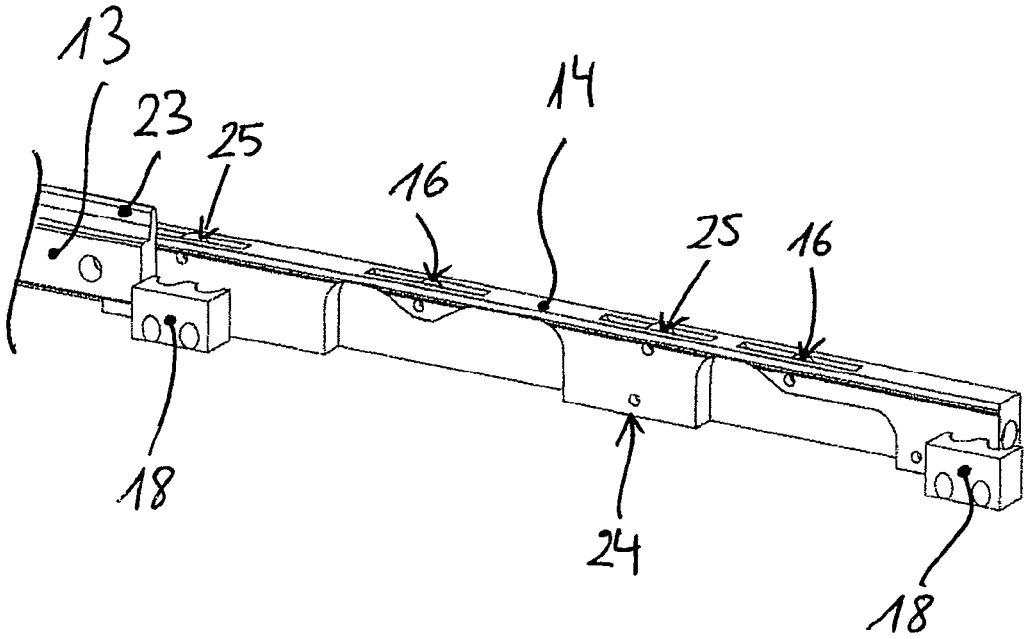
FIG. 4 is another perspective view of components of the inventive clamping mechanism in the first position of the clamping mechanism.
Figure 6:
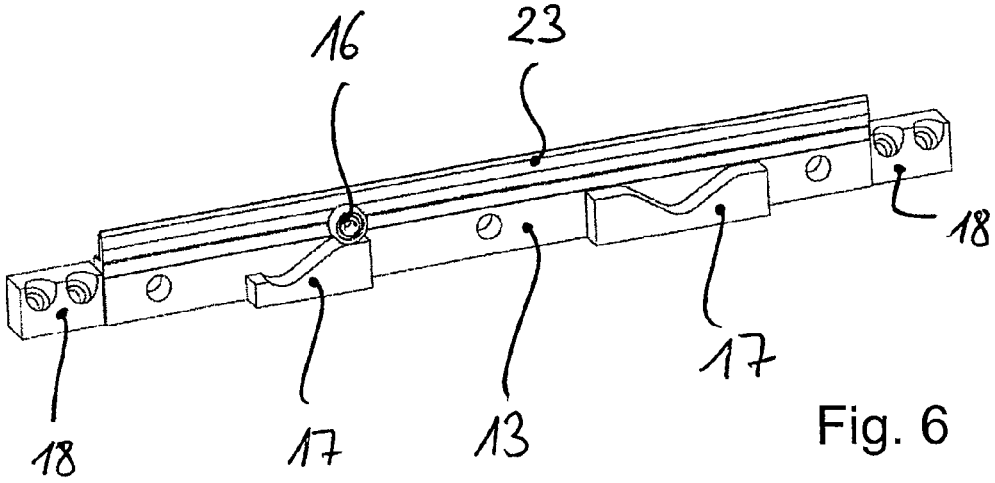
FIG. 6 is a perspective view of components of the inventive clamping mechanism in the second position of the clamping mechanism.

FIGS. 2, 4 and 6 show different perspective views of components of the inventive clamping mechanism 12.

The inventive clamping mechanism 12, which is integrated into the lockup slot 11 of the plate cylinder 10, is comprised of a clamping element 13 as well as an actuating element 14. The clamping element 13 is used to clamp a leading end and/or a trailing end of at least one printing plate. The actuating element 14 is used to actuate the clamping element 13 in order to transfer the clamping element between two positions, namely between a first position, in which the clamping element 13 clamps the leading end and/or the trailing end of the or each printing plate, and a second position, in which the clamping element 13 releases the leading end and/or the trailing end of the or each printing plate.

In terms of the present invention, the clamping element 13 can be adjusted exclusively in the radial direction of the plate cylinder 10. The actuating element 14, on the other hand, can be displaced exclusively in the axial direction of the plate cylinder 10. Depending upon the relative position of the actuating element 14 relative to the clamping element 13, the clamping element 13 assumes one of the two positions, i.e., either the first position, in which the clamping element 13 clamps the leading end and/or the trailing end of the or each printing plate, or the second position, in which the clamping element 13 releases the leading end and/or the trailing end of the or each printing plate. To do so, the clamping element 13 cooperates with at least one clamping spring 15, which acts on a radial interior surface of the clamping element 13 and, due to the spring force, presses the clamping element radially outwardly into the first position, in which the clamping element clamps the leading end and/or the trailing end of the or each printing plate. By moving the actuating element 14 in the axial direction, the clamping element 13 is displaced radially inwardly into the second position against the spring force of the or each clamping spring 15 to release the leading end and/or of the trailing end of the or each printing plate.

In the depicted exemplary embodiment, the actuating element 14 is assigned first bearings 16, which cooperate with the guide curves 17 assigned to the clamping element 13. The guide curves 17 can be displaced together with the clamping element 13 exclusively in the radial direction. The first bearings 16 can be displaced together with the actuating element 14 exclusively in the axial direction. Then, when, as FIGS. 1 and 2 depict, the actuating element 14 assumes a relative axial position with respect to the clamping element 13 and thus the first bearings 16 relative to the guide curves 17, in which position the first bearings 16 are aligned with the guide curves 17, the or each clamping spring 15 presses the clamping element 13 radially outwardly into the first position, in which the clamping element 13 clamps the leading end and/or the trailing end of the or each printing plate. According to FIGS. 1 and 2, in this relative axial position, the first bearings 16 do not abut the guide curves 17 so that the spring force of the or each clamping spring 15 is fully effective and the clamping element 13 can be pressed radially outwardly with maximal spring force.

Then, on the other hand, when, due to axial displacement of the actuating element 14 relative to the clamping element 13, the first bearings 16 come to bear on the guide curves 17 and align with high points of the guide curves 17, as shown in FIGS. 5 and 6, the clamping element 13 is pressed radially inwardly via the actuating element 14 against the spring force of the or each clamping spring 15 into the second position, in which the clamping element 13 releases the leading end and/or the trailing end of the or each printing plate.

As already mentioned, the clamping element 13 can be displaced exclusively in the radial direction of the plate cylinder 10, whereby the axial position of the clamping element 13 is fixed by lateral abutments 18. The abutments 18 are also used as lateral abutments for the actuating element 14 in the circumferential direction of the plate cylinder.

The actuating element 14 can be displaced exclusively in the axial direction of the plate cylinder, whereby its radial position is fixed by a section 19 of an element 20, whereby this section 19 of the element covers the actuating element 14 radially outwardly.

The section 19 of the element 20 together with a section 21 of the plate cylinder 10 delimits a gap 22, in which, to clamp the leading end and/or the trailing end of the or each printing plate, a projection 23 of the clamping element 13 engages in the first position of the clamping element (see FIGS. 1, 3). The clamping element 13 is embodied in such a way that the projection 23 clamps the leading end and trailing end at the same angles.

In order to facilitate the axial displaceability of the actuating element 14 relative to the clamping element 13, the actuating element 14 also comprises, along with the first bearings 16, second bearings 24, 25, which cooperate with the guide curves 17 of the clamping element 13. The second bearings 24 are positioned radially inwardly and the second bearings 25 are positioned radially outwardly. When there is an axial adjustment of the actuating element 14 relative to the clamping element 13, the second bearings 24 roll off a radially internal surface of the lockup slot 11. When there is an axial adjustment of the actuating element 14 relative to the clamping element 13, the second bearings 25 roll off a surface of the element 20. This can be seen best in FIG. 3. The second bearings 24, 25 are used as a radial fixation or support of the actuating element 14.

The clamping element 13 and the actuating element 14 are integrated in such a way into the lockup slot 11 of the plate cylinder 10 that the elements are positioned next to one other as viewed in the circumferential direction. The first bearings 16 are assigned to the actuating element 14 and the guide curves 17 to the clamping element 13 on opposing, neighboring side surfaces of same.

In the depicted exemplary embodiment, the guide curves 17 are assigned to the clamping element 13 and the first bearings 16 to the actuating element 14. In contrast to this, it is also possible for the guide curves to be assigned to the actuating element and the first bearings to the clamping element.

LIST OF REFERENCE NUMERALS

10 Plate cylinder
11 Lockup slot
12 Clamping mechanism
13 Clamping element
14 Actuating element
15 Clamping spring
16 First bearings
17 Guide curves
18 Abutment
19 Section
20 Element
21 Section
22 Gap
23 Projection
24 Second bearings
25 Second bearings The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A clamping mechanism for a printing plate, comprising a clamping element that is integrated into a lockup slot of a plate cylinder for clamping a leading end and/or a trailing end of the printing plate, and an actuating element that is integrated into the lockup slot of the plate cylinder, wherein the clamping element is transferable by the actuating element between a first position, in which the clamping element is able to clamp the leading end and/or the trailing end of the printing plate, and a second position, in which the clamping element is able to release the leading end and/or the trailing end of the printing plate, wherein the clamping element is adjustable exclusively in a radial direction of the plate cylinder and the actuating element is adjustable exclusively in an axial direction of the plate cylinder in such a way that, depending upon a relative axial position of the actuating element with respect to the clamping element, the clamping element is displaceable either radially outwardly due to a spring force of a clamping spring for clamping the leading end and/or the trailing end of the printing plate or is displaceable radially inwardly against the spring force of the clamping spring for releasing the leading end and/or the trailing end of the printing plate, and wherein the actuating element is assigned first bearings, which, when there is an axial adjustment of the actuating element relative to the clamping element, roll off guide curves assigned to the clamping element.

2. The clamping mechanism according to claim 1, wherein the clamping spring acts on a radial interior surface of the clamping element.

3. The clamping mechanism according to claim 1, wherein an axial position of the clamping element is fixed by lateral abutments.

4. The clamping mechanism according to claim 3, wherein a circumferential position of the actuating element is fixed by the lateral abutments.

5. The clamping mechanism according to claim 1, wherein a radial position of the actuating element is fixed by a section of an element, wherein the section covers the actuating element radially outwardly.

6. A clamping mechanism for a printing plate, comprising a clamping element that is integrated into a lockup slot of a plate cylinder for clamping a leading end and/or a trailing end of the printing plate, and an actuating element that is integrated into the lockup slot of the plate cylinder, wherein the clamping element is transferable by the actuating element between a first position, in which the clamping element is able to clamp the leading end and/or the trailing end of the printing plate, and a second position, in which the clamping element is able to release the leading end and/or the trailing end of the printing plate, wherein the clamping element is adjustable exclusively in a radial direction of the plate cylinder and the actuating element is adjustable exclusively in an axial direction of the plate cylinder in such a way that, depending upon a relative axial position of the actuating element with respect to the clamping element, the clamping element is displaceable either radially outwardly due to a spring force of a clamping spring for clamping the leading end and/or the trailing end of the printing plate or is displaceable radially inwardly against the spring force of the clamping spring for releasing the leading end and/or the trailing end of the printing plate, and wherein the actuating element is assigned bearings, which, when there is an axial adjustment of the actuating element relative to the clamping element, act as a radial fixation or support of the actuating element.

7. A clamping mechanism for a printing plate, comprising a clamping element that is integrated into a lockup slot of a plate cylinder for clamping a leading end and/or a trailing end of the printing plate, and an actuating element that is integrated into the lockup slot of the plate cylinder, wherein the clamping element is transferable by the actuating element between a first position, in which the clamping element is able to clamp the leading end and/or the trailing end of the printing plate, and a second position, in which the clamping element is able to release the leading end and/or the trailing end of the printing plate, wherein the clamping element is adjustable exclusively in a radial direction of the plate cylinder and the actuating element is adjustable exclusively in an axial direction of the plate cylinder in such a way that, depending upon a relative axial position of the actuating element with respect to the clamping element, the clamping element is displaceable either radially outwardly due to a spring force of a clamping spring for clamping the leading end and/or the trailing end of the printing plate or is displaceable radially inwardly against the spring force of the clamping spring for releasing the leading end and/or the trailing end of the printing plate, and wherein the clamping element and the actuating element are integrated into the lockup slot of the plate cylinder in such a way that the elements are positioned next to one another, as viewed in a circumferential direction, wherein first bearings and guide curves are assigned on opposing, neighboring side surfaces of the elements.

8. A plate cylinder of a printing couple of a printing press having a lockup slot, wherein a clamping mechanism for a printing plate is integrated into the lockup slot, and wherein the clamping mechanism for the printing plate is embodied according to claim 1.

9. A clamping mechanism for a printing plate cylinder, comprising:

a clamping element moveable in a radial direction of the plate cylinder; and an actuating element moveable in an axial direction of the plate cylinder;

wherein an axial movement of the actuating element causes a radial movement of the clamping element;

wherein the clamping element includes a guide curve, wherein the actuating element includes a bearing, and wherein the bearing is engageable with the guide curve;

and wherein when the actuating element is moved in a first axial direction the bearing engages with a high point of the guide curve such that the clamping element is pressed in a radially inward direction.

10. The clamping mechanism according to claim 9, wherein when the actuating element is moved in a second axial direction the bearing disengages with the high point of the guide curve such that the clamping element is pressed in a radially outward direction.

11. The clamping mechanism according to claim 10, wherein when the clamping element is pressed in the radially outward direction the clamping element is engageable with a printing plate on the plate cylinder.

12. The clamping mechanism according to claim 9, wherein when the clamping element is pressed in the radially inward direction the clamping element is not engageable with a printing plate on the plate cylinder.

13. A method for operating a clamping mechanism in a printing plate cylinder, comprising the steps of:

axially moving an actuating element of the clamping mechanism in a lockup slot of the plate cylinder; and radially moving a clamping element of the clamping mechanism in the lockup slot of the plate cylinder by the axial movement of the actuating element;

wherein the clamping element includes a guide curve, wherein the actuating element includes a bearing, and wherein the step of radially moving the clamping element of the clamping mechanism in the lockup slot of the plate cylinder by the axial movement of the actuating element includes a step of disengaging the bearing with a high point of the guide curve;

and wherein the step of radially moving the clamping element of the clamping mechanism in the lockup slot of the plate cylinder by the axial movement of the actuating element includes a step of pressing the clamping mechanism in a radially outward direction by a spring.

14. The method according to claim 13, wherein the step of radially moving the clamping element of the clamping mechanism in the lockup slot of the plate cylinder by the axial movement of the actuating element includes a step of engaging the bearing with the high point of the guide curve.

* * * * *